US011187009B2

(12) United States Patent
Frame et al.

(10) Patent No.: US 11,187,009 B2
(45) Date of Patent: Nov. 30, 2021

(54) STRIKER FOR USE IN LATCH ASSEMBLY

(71) Applicant: Southco, Inc., Concordville, PA (US)

(72) Inventors: Matthew Butler Frame, Honeoye Falls, NY (US); Brandon Vaughan Hastings, Hemlock, NY (US); Richard B. Langkamp, Jr., Hemlock, NY (US); Ismael Rodriguez, West Chester, PA (US)

(73) Assignee: Southco, Inc., Concordville, PA (US)

( * ) Notice: Subject to any disclaimer, the term of this patent is extended or adjusted under 35 U.S.C. 154(b) by 458 days.

(21) Appl. No.: 16/313,591

(22) PCT Filed: Jun. 28, 2017

(86) PCT No.: PCT/US2017/039677

§ 371 (c)(1),
(2) Date: Dec. 27, 2018

(87) PCT Pub. No.: WO2018/005607

PCT Pub. Date: Jan. 4, 2018

(65) Prior Publication Data

US 2019/0249457 A1 Aug. 15, 2019

Related U.S. Application Data

(60) Provisional application No. 62/356,162, filed on Jun. 29, 2016.

(51) Int. Cl.

| | |
|---|---|
| ***E05B 15/02*** | (2006.01) |
| ***E05B 15/04*** | (2006.01) |
| ***E05B 85/04*** | (2014.01) |

(52) U.S. Cl.

CPC ..... *E05B 15/022* (2013.01); *E05B 15/0295* (2013.01); *E05B 15/04* (2013.01);
(Continued)

(58) Field of Classification Search

CPC .. Y10T 292/68; Y10T 292/702; Y10S 292/61; E05B 15/02; E05B 15/0205;
(Continued)

(56) References Cited

U.S. PATENT DOCUMENTS 938,926 A * 11/1909 Weidel ..... E05B 65/0811 70/96
1,715,590 A * 6/1929 Burhenne ..... E05F 11/00 292/228

(Continued)

FOREIGN PATENT DOCUMENTS

CN 1837563 A 9/2006
CN 204728845 U 10/2015

(Continued)

OTHER PUBLICATIONS

Chinese Office Action for Chinese Application No. 201780040035.X, dated May 27, 2020, with translation, 17 pages.

(Continued)

*Primary Examiner* — Carlos Lugo
(74) *Attorney, Agent, or Firm* — RatnerPrestia

(57) ABSTRACT

A striker assembly includes a housing, a striker, and a spring. The housing has opposed sidewalls, each of which defines an aperture. The striker extends between the sidewalls of the housing with end portions of the striker positioned within respective apertures defined in the sidewalls. Each of the pair of end portions defines a surface extending in a transverse direction. The spring has a pair of end portions. Each spring end portion contacts the surface of a respective striker end portion. The spring is engaged with the housing to bias the end portions of the striker toward a centered position of the respective apertures. At least one of the end portions of the striker is movable transversely within the respective aperture away from the centered position of the respective
(Continued)

aperture and is biased toward the centered position of the respective aperture.

25 Claims, 13 Drawing Sheets

(52) U.S. Cl.
CPC .... *E05B 85/045* (2013.01); *E05B 2015/0437* (2013.01); *Y10S 292/61* (2013.01); *Y10T 292/68* (2015.04); *Y10T 292/702* (2015.04)

(58) Field of Classification Search
CPC .... E05B 15/022; E05B 15/0295; E05B 15/04; E05B 2015/0437
See application file for complete search history.

(56) References Cited

U.S. PATENT DOCUMENTS 2,817,554 A * 12/1957 Hasselmark ..... E05C 19/022 292/340
2,893,775 A * 7/1959 George ..... E05B 63/244 292/341.17
2,957,721 A * 10/1960 Sklaw ..... E05B 63/244 292/341.15
3,179,458 A * 4/1965 Sconzo ..... E05B 15/0245 292/341.15
4,225,166 A * 9/1980 Tanaka ..... E05B 63/24 292/341.17
4,383,599 A * 5/1983 Maxwell ..... G07F 9/10 194/290
4,848,810 A * 7/1989 Gosse ..... E05B 47/0603 292/129
4,988,134 A * 1/1991 Vidwans ..... B60N 2/433 292/198
5,342,103 A * 8/1994 Tame ..... B60N 2/366 292/246
5,707,092 A 1/1998 Van Slembrouck et al.
6,106,037 A * 8/2000 Burton ..... E05B 85/045 292/340
7,137,656 B2 * 11/2006 Bird ..... B62D 25/10 292/341.12
7,416,228 B2 * 8/2008 Pfitzinger ..... E05B 15/0046 292/214
7,726,707 B2 6/2010 Simchayoff et al.
7,780,208 B2 * 8/2010 Koppenhoehl ..... B60R 21/38 292/340
7,854,452 B2 * 12/2010 Nishio ..... B21F 45/00 292/340
8,047,582 B1 * 11/2011 Rodgers ..... E05B 65/0007 292/201
8,496,275 B2 7/2013 Garneau et al.
9,279,589 B2 * 3/2016 Lau ..... E05B 3/00
9,840,858 B2 12/2017 Farooq et al.
2006/0208503 A1 9/2006 Simchayoff et al.
2009/0108592 A1 * 4/2009 De Vries ..... E05B 15/0245 292/164
2012/0112477 A1 * 5/2012 Muramatsu ..... E05B 85/045 292/340

FOREIGN PATENT DOCUMENTS

DE 645211 C * 5/1937 ..... E05B 83/24
DE 3804176 A * 2/1988
FR 2736958 A1 * 1/1997 ..... E05B 15/024
FR 2893344 A1 * 5/2007 ..... B60J 5/101
GB 1317916 A 5/1973
WO 02059443 A1 8/2002

OTHER PUBLICATIONS

Indian Examination Report for Indian Application No. 201817049844, dated Mar. 19, 2021, with translation, 6 pages.
International Search Report and Written Opinion for International Application No. PCT/US2017/039677, dated Sep. 15, 2017—10 pages.
International Preliminary Reporton Patentability for International Application No. PCT/US2017/039677, dated Jan. 1, 2019, 7 pages.

* cited by examiner 100
112
110
114
114
134
134
150

114
132
130
120
118
114
134
110
112
150

114
130
114
134
132
110

118
114
134
110
112
120

116
110
116
112

110
112
114
120
118
SECTION D-D 114
118
114
120
118
112

116
116
D
D
120
112

114
114
112

118
114
112

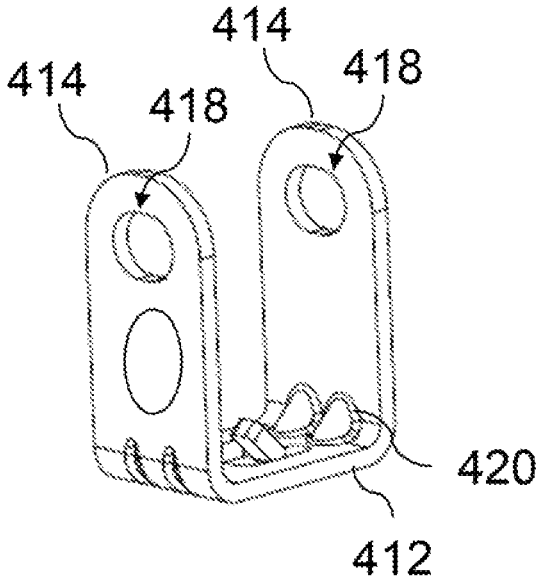
FIG. 12A
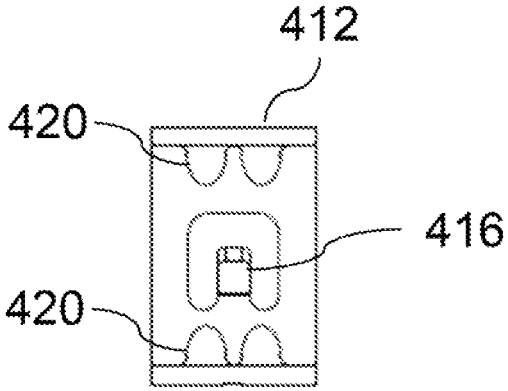
FIG. 12B
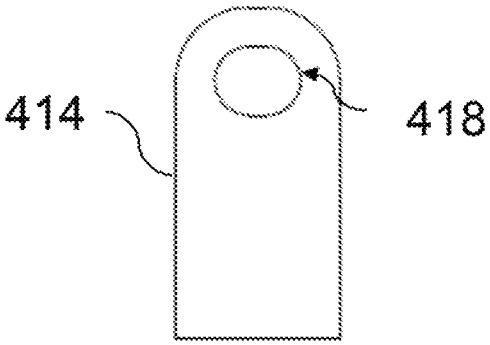
FIG. 12C
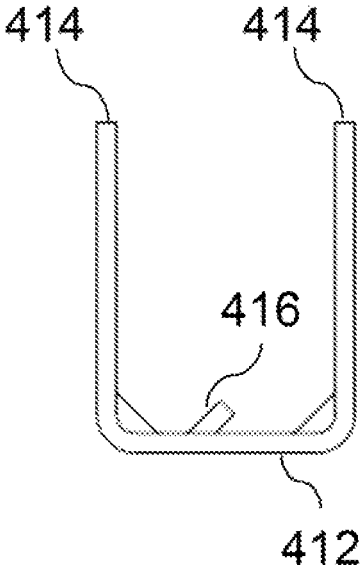
FIG. 12D
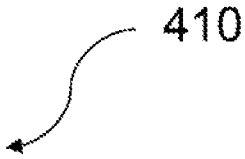

STRIKER FOR USE IN LATCH ASSEMBLY

CROSS-REFERENCE TO RELATED APPLICATIONS

This application is a U.S. National Phase Application of PCT International Application PCT/US2017/039677, filed Jun. 28, 2017, which is related to, and claims the benefit of priority of, U.S. Provisional Application No. 62/356,162, entitled STRIKER FOR USE IN LATCH ASSEMBLY, filed on 29 Jun. 2016, the contents of which are incorporated herein by reference in their entirety for all purposes.

FIELD OF THE INVENTION

The present invention relates to the field of latch assemblies, and more particularly, to strikers for use in latch assemblies.

BACKGROUND OF THE INVENTION

Latch assemblies are relied on in many applications for securing items such as panels together. One example of an important use for latches is in the automotive field, where there is a desire and need to access automotive compartments, such as, for example, passenger compartments of vehicles. Various latches for panel closures have been employed where one of the panels such as a swinging door or the like is to be fastened or secured to a stationary panel, doorframe, or compartment body.

Rotary latches, for example, typically capture a striker in two axes by rotation of a pawl which is activated by a trigger. There may be freedom of movement between the latch and the striker along the axis of the striker. This axial movement allows for manufacturing tolerance in the fit between the frame or first member to which the latch is mounted and the door or second member to which the striker is mounted.

Latch components used to date have presented a number of drawbacks that typically have left the securing of a striker more awkward, time-consuming and difficult to install, remove, open, close, latch, and unlatch. In addition, difficulties have been encountered when a striker to which a latch such as a rotary latch is to be secured is off-center with respect to being aligned with a catch for engagement with the striker. There are instances when it is not practical to ensure that tight tolerances will be maintained in door or frames such that the striker will always fall into the notch or mouth of the latch. The reason for misalignment between the latch and striker can be manufacturing and assembly tolerances, expansion and contraction of the structure due to environmental conditions, shifting of components due to wear during use or distortion of components due to abuse.

In view of the above, improved latch assemblies, and particularly improved strikers for use in latch assemblies, are desired.

SUMMARY OF THE INVENTION

Aspects of the present invention relate to striker assemblies and latch assemblies.

In accordance with one aspect of the present invention, a striker assembly is disclosed. The striker assembly includes a housing, a striker, and a spring. The housing has opposed sidewalls. Each of the sidewalls defines an aperture. The striker has a pair of end portions. The striker extends between the sidewalls of the housing with each of the pair of end portions positioned within a respective aperture defined in the sidewalls of the housing. Each of the pair of end portions defines a surface extending in a transverse direction. The spring has a pair of end portions. Each spring end portion contacts the surface of a respective striker end portion. The spring is engaged with the housing to bias the end portions of the striker toward a centered position of the respective apertures. At least one of the end portions of the striker is movable transversely within the respective aperture away from the centered position of the respective aperture and is biased toward the centered position of the respective aperture.

In accordance with another aspect of the present invention, another striker assembly is disclosed. The striker assembly includes a housing, a striker, and a single spring. The housing has a base and a pair of opposed sidewalls extending from the base. The base includes one or more openings sized to receive a fastener. Each of the sidewalls defines an aperture. The housing further includes a pair of ridges defining a channel at an area of coupling between each sidewall and the base. The striker has a pair of end portions. The striker extends between the sidewalls with each of the pair of end portions positioned within a respective aperture. Each of the pair of end portions has a hole extending diametrically therethrough. The spring has a body and a pair of end portions. Each spring end portion has a portion extending through the hole in a respective striker end portion. The spring is engaged with the housing such that the body of the spring passes through each channel and at least partially encircles an outer edge of each of the openings in the base of the housing.

In accordance with yet another aspect of the present invention, a latch assembly is disclosed. The latch assembly includes a latch and a striker assembly. The latch has a pawl. The striker assembly is positioned to engage the pawl of the latch. The striker assembly may include the features of either of the striker assemblies set forth above. At least one of the end portions of the striker is movable transversely within the respective aperture away from the centered position of the respective aperture upon contact with the pawl of the latch and is biased toward the centered position of the respective aperture upon release of the pawl of the latch.

BRIEF DESCRIPTION OF THE DRAWINGS

The invention is best understood from the following detailed description when read in connection with the accompanying drawings. When a plurality of similar elements are present, a single reference numeral may be assigned to the plurality of similar elements with a small letter designation referring to specific elements. When referring to the elements collectively or to a non-specific one or more of the elements, the small letter designation may be dropped. It is emphasized that, according to common practice, the various features of the drawings are not necessarily to scale. On the contrary, the dimensions of the various features may be arbitrarily expanded or reduced for clarity. Included in the drawings are the following figures:

FIGS. 7A and 78 are top and side views, respectively, depicting the exemplary latch assembly of FIG. 6A in a second position;

FIGS. 12A-12D depict an exemplary support in the form of a housing of the striker assembly of FIG. 11A.

DETAILED DESCRIPTION OF THE INVENTION

Figures 1A, 1B, 1C, 1D, 1E:
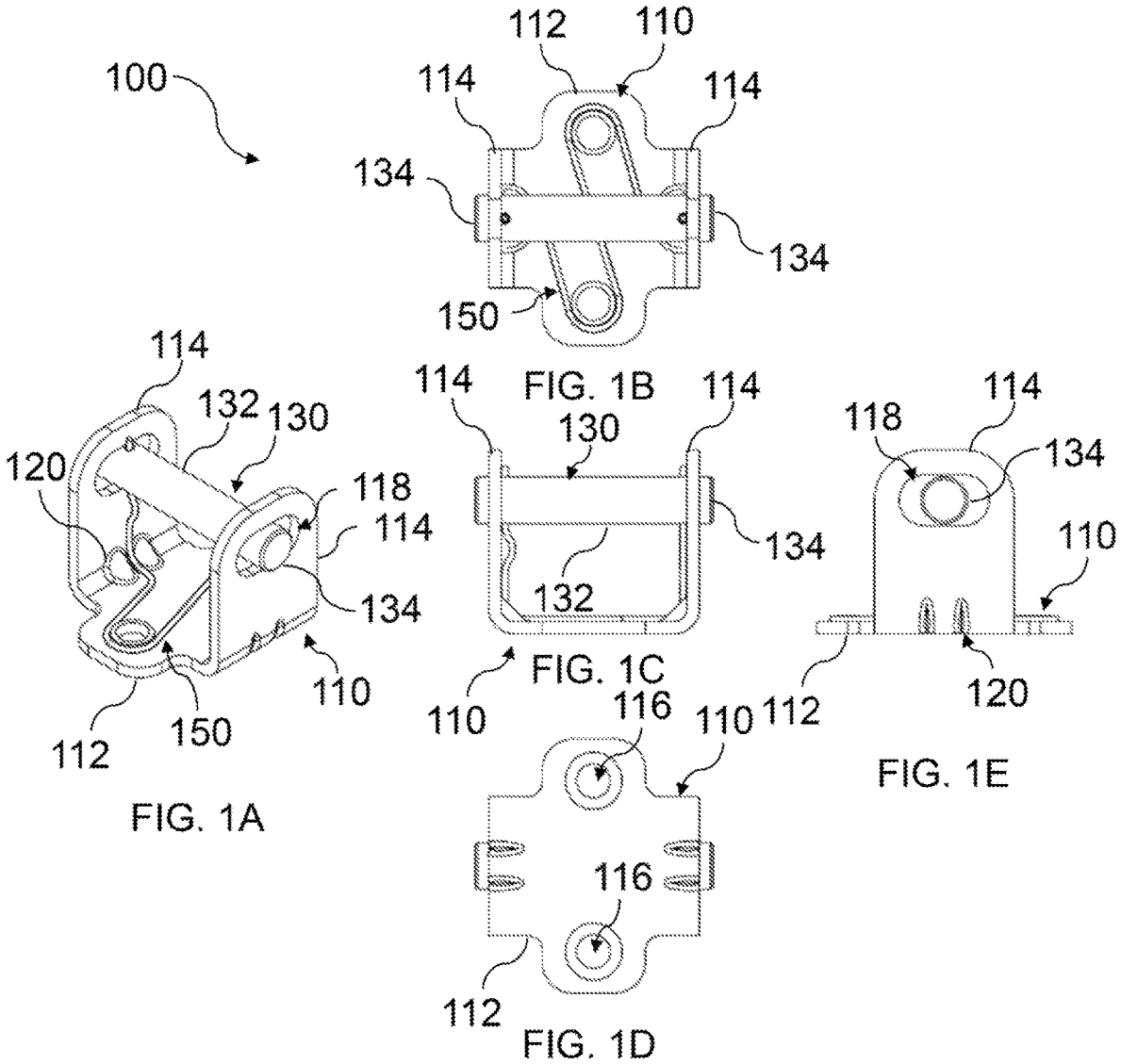
FIGS. 1A-1E depict an exemplary striker assembly in accordance with aspects of the present invention.
Figures 2A, 2B, 2C, 2D, 2E:
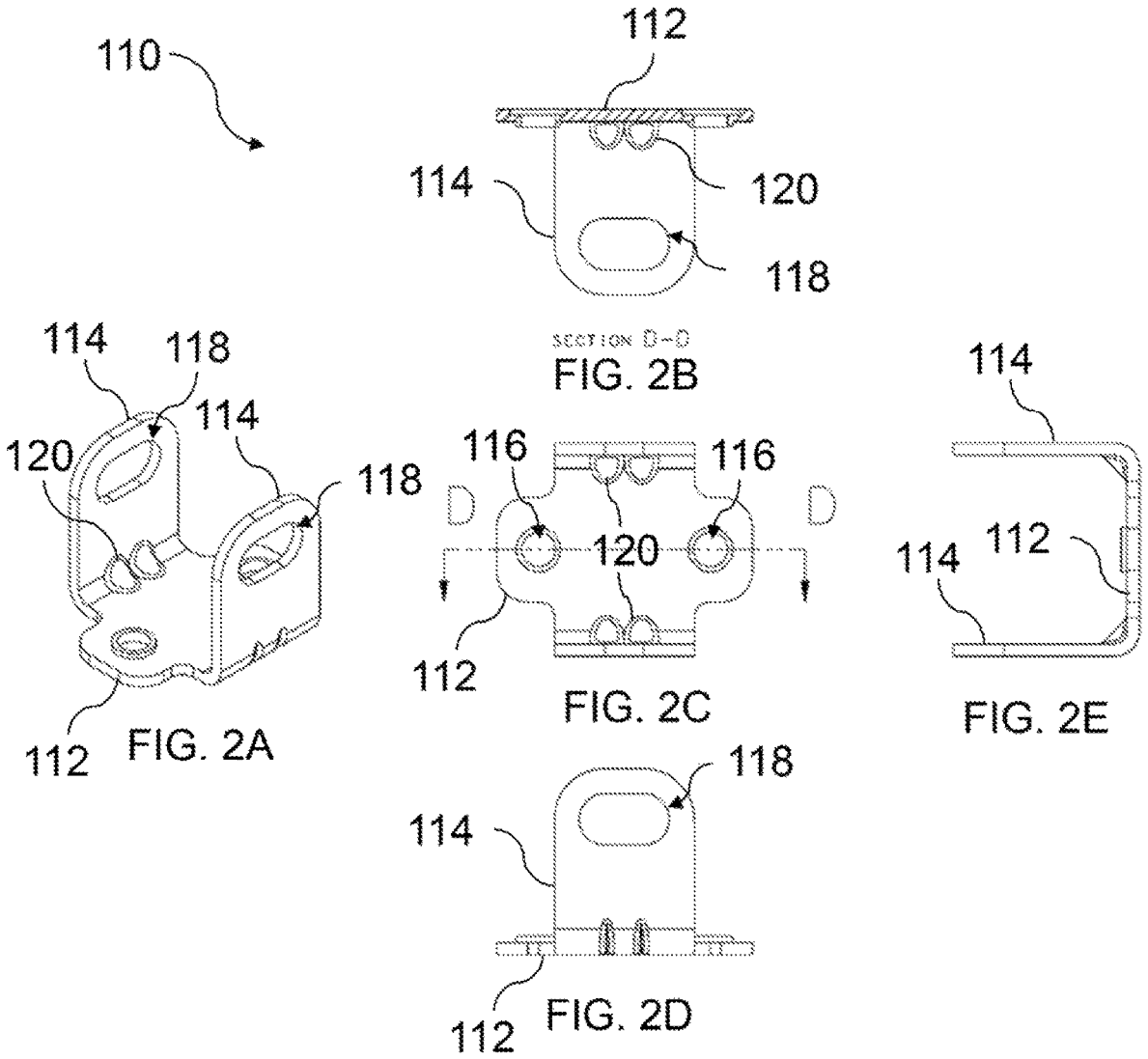
FIGS. 2A-2E depict an exemplary support in the form of a housing of the striker assembly of FIG. 1A.
Figure 3A:
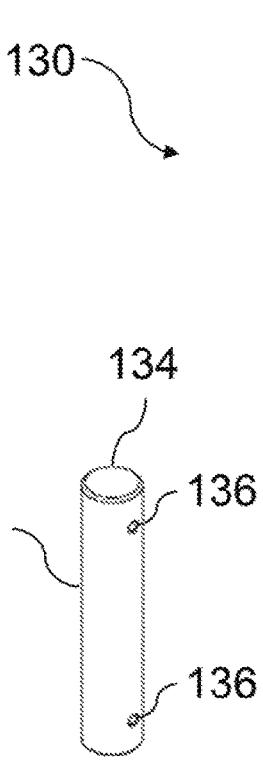
FIGS. 3A-3E depict an exemplary striker of the striker assembly of FIG. 1A.
Figure 3B:
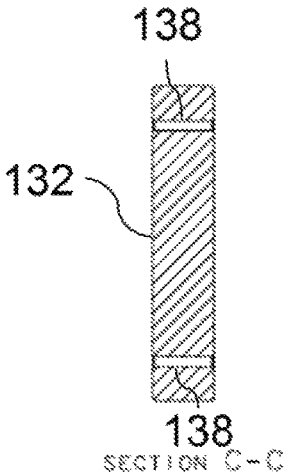
Figure 3C:
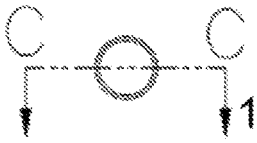
Figure 3E:
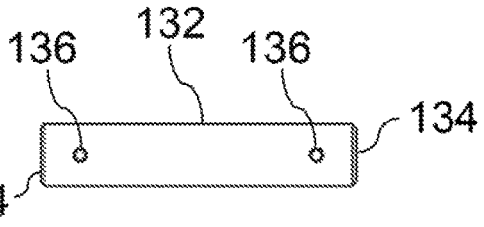
Figure 3D:
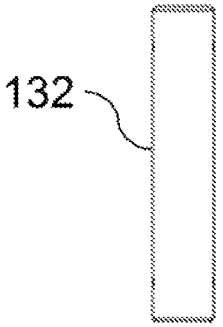

Although the invention is illustrated and described herein with reference to specific embodiments, the invention is not intended to be limited to the details shown. Rather, various modifications may be made in the details within the scope and range of equivalents of the claims and without departing from the invention.

The exemplary embodiments described below relate to strikers for use in latch assemblies. As used herein, the term "floating" refers to a striker which is not rigidly held in place at either end, but is capable of limited movement in engagement with the accompanying latch assembly. Suitable latches employing the disclosed strikers will be known to one of ordinary skill in the art from the description herein. By way of example, latch assemblies that may employ the disclosed strikers are described in U.S. Pat. No. 7,726,707, entitled "ROTARY PAWL LATCH," issued Jun. 1, 2010, the contents of which are incorporated herein by reference in their entirety.

Referring now to the drawings, FIGS. 1A-1E illustrate an exemplary striker assembly 100 in accordance with aspects of the present invention. Striker assembly 100 may form part of a latch assembly. As a general overview, striker assembly 100 includes a support component such as housing 110, a striker 130, and a spring 150. Additional details of striker assembly 100 are provided below.

Housing 110 provides a base for striker assembly 100. As shown in FIGS. 2A-2E, housing 110 includes a base 112 and a pair of opposed side portions such as sidewalls 114 extending upward from the base 112. Base 112 of housing 110 includes one or more openings 116. Openings 116 are sized to receive a fastener for securing housing 110 (and striker assembly 100) to another object, such as a panel or frame. Suitable fasteners for securing housing 110 to the other object include bolts, rivets, screws, and/or other structures, and will be known to one of ordinary skill in the art from the description herein.

Each sidewall 114 of housing 110 defines a respective aperture 118. Apertures 118 have at least one dimension that is sized to be larger than a dimension of the striker 130; for example, apertures 118 are shaped in the form of a slot having length dimension that is larger than a diameter of striker 130 to enable lateral movement of striker 130 within apertures 118 when striker 130 is received within apertures 118.

Housing 110 may further include a pair of ridges 120 at an area of coupling between base 112 and each sidewall 114. Each pair of ridges 120 defines a channel in which spring 150 may be positioned, as described in greater detail below.

Striker 130 provides a surface for engaging with the corresponding latch assembly. As shown in FIGS. 3A-3E, striker 130 has a body 132 with a pair of end portions 134 in opposite sides. Each end portion 134 includes a respective hole 136 extending transversely through striker 130. Holes 136 form a surface 138 against which a corresponding portion of spring 150 may bear, as discussed below.

While holes 136 are illustrated as extending diametrically through respective end portions 134, it will be understood that each hole 136 may extend only partly through striker 130, or may extend obliquely through striker 130. Alternatively, surfaces 138 may be formed from cutouts, notches, steps, or other structures in each end portion 134 of striker 130.

When striker assembly 100 is assembled, as shown in FIGS. 1A-1E, striker 130 extends between sidewalls 114 of housing 110, with each end portion 134 positioned within a pair of a respective aperture 118. The end portions 134 of striker 130 have a diameter smaller than the size of each aperture 118. As a result, the end portions 134 of striker 130 are movable transversely (i.e. orthogonally to the axis of striker 130) within their respective apertures 118.

Spring 150 biases striker 130 relative to housing 110. As shown in FIGS. 4A-4E, spring 150 has a body 152 with a pair of end portions 154 on opposite sides. Spring 150 is formed from a single piece of wire. The single piece of wire is provided with a plurality of bends shaped to promote coupling of spring 150 with striker 130 and housing 110. An exemplary shape of spring 150 is set forth below.

In the exemplary embodiment of FIGS. 4A-4E, spring 150 includes a first straight portion 160 forming an end portion 154 of spring 150. The first straight portion 160 extends to a bump 162, and a second straight portion 164 extends from bump 162 to a first bend 166. The use of a bump 162 may simplify manufacture by preventing the end portion 154 of spring 150 from moving too far in the vertical direction through hole 136 in striker 130. In some embodiments, nonetheless, it will be understood that bump 162 may be omitted, resulting in the first and second straight portions 160 and 164 forming a single straight portion. A third straight portion 168 extends from the first bend 166 to a second bend 170. A fourth straight portion 172 extends from the second bend 170 to a third bend 174, and a fifth straight portion 176 extends from the third bend 174 to a fourth bend 178. A sixth straight portion 180 extends from the fourth bend 178, and forms another end portion 154 of spring 150. It will further be understood that this sixth straight portion 180 could also include a bump (similar to bump 162), either additionally or alternatively to bump 162, in which case the sixth straight portion would be divided into two straight portions (similar to first and second straight portions 160 and 164).

When striker assembly 100 is assembled, as shown in FIGS. 1A-1E, end portions 154 of spring 150 contact surfaces 138 of respective end portions 134 of striker 130. In an exemplary embodiment, end portions 154 of spring 150 extend through holes 136 in respective end portions 134 of striker 130.

Figure 4B:
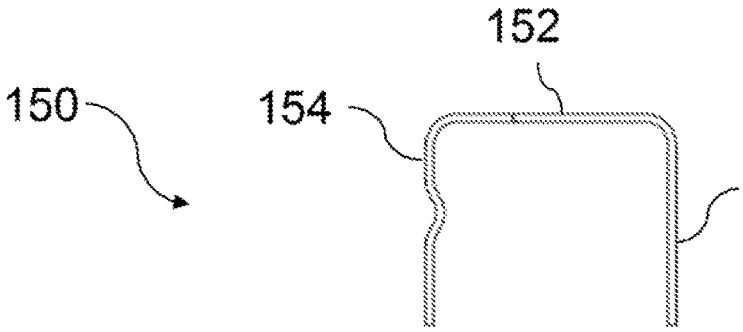
FIGS. 4A-4E depict an exemplary spring of the striker assembly of FIG. 1A.
Figure 4A:
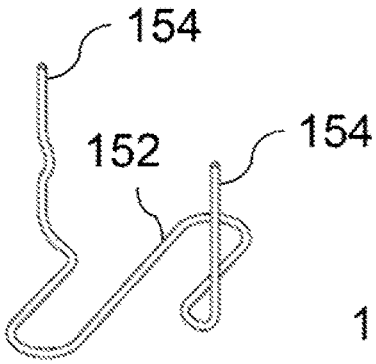
Figure 4C:
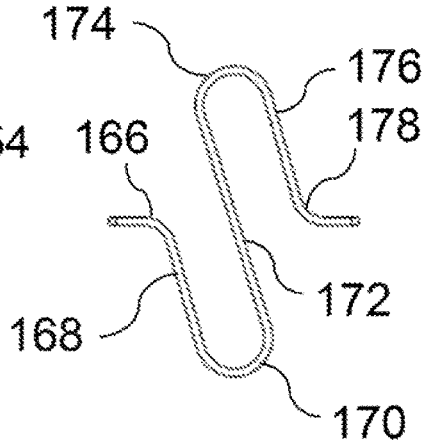
Figure 4E:
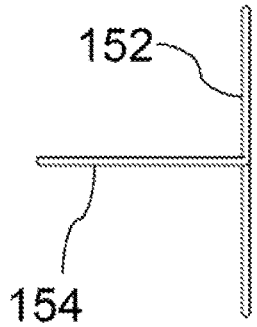
Figure 4D:
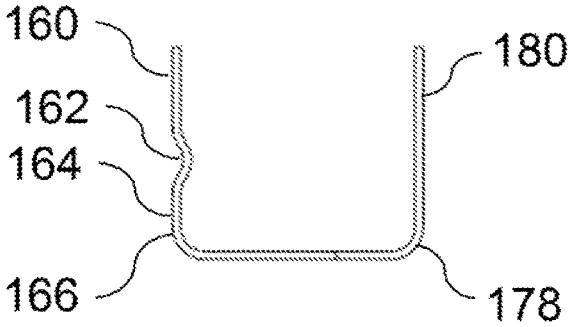

Additionally, when striker assembly 100 is assembled, body 152 of spring 150 is coupled with housing 110. In an exemplary embodiment, body 152 of spring 150 passes through each channel defined by the pairs of ridges 120 in the area of coupling of sidewalls 114 to base 112 of housing 110. Further, body 152 of spring 150 at least partially encircles outer edges of the openings 116 in housing 110, in order to secure spring 150 to housing 110 when fasteners are in place. In the embodiment of FIGS. 1B and 4C, second bend 170 and third bend 174 in body 152 of spring 150 partially encircle the outer edges of openings 116 in housing 110.

As set forth above, spring 150 biases striker 130 relative to housing 110. Spring 150 functions to maintain a predetermined position of striker 130 relative to housing 110, while allowing limited movement of striker 130 relative to housing 110. In an exemplary embodiment, spring 150 is engaged with housing 110 to bias end portions 134 of striker 130 toward a centered position of end portions 134 within apertures 118, as shown in FIG. 1E. During engagement with the latch assembly, one or both of end portions 134 of striker 130 may be moved away from the centered position of the respective aperture 118, and will then be biased back toward the centered position of the respective aperture 118 through contact with the end portions 154 of spring 150. Accordingly, the striker can be considered to be self-centering.

Additionally, engagement of spring 150 with surfaces 138 of striker 130 limits or prevents movements of striker 130 axially through either aperture 118 out of housing 110. In this way, engagement of spring 150 with surfaces 138 of striker 130 maintains both a traverse and axial position of striker 130 relative to housing 110.

Striker assembly 100 preferably includes only a single spring 150. In embodiments described herein, a single spring is used to perform the function of biasing striker 130 in a transverse direction relative to housing 110 and preventing axial movement of striker 130 relative to housing 110. The use of a single spring to perform these functions may achieve a number of advantages over convention designs, including a reduction in components, a simpler design, manufacture, and assembly. Likewise, the use of a design in which spring 150 engages with striker 130 by insertion into holes 136 enables striker assembly to be simply assembled by hand without fixtures.

Spring 150 allows some transverse movement of striker 130, and also prevents striker 130 from inadvertent disengagement from housing 110. Accordingly, spring 150 performs multiple functions. In this way, spring 150 renders additional components (such as a leaf spring for example) optional by allowing some transverse movement of striker 130. Also, spring 150 renders additional components (such as shear pins or cotter pins or e-clips) optional by preventing striker 130 from inadvertent disengagement from housing 110.

Figure 5:
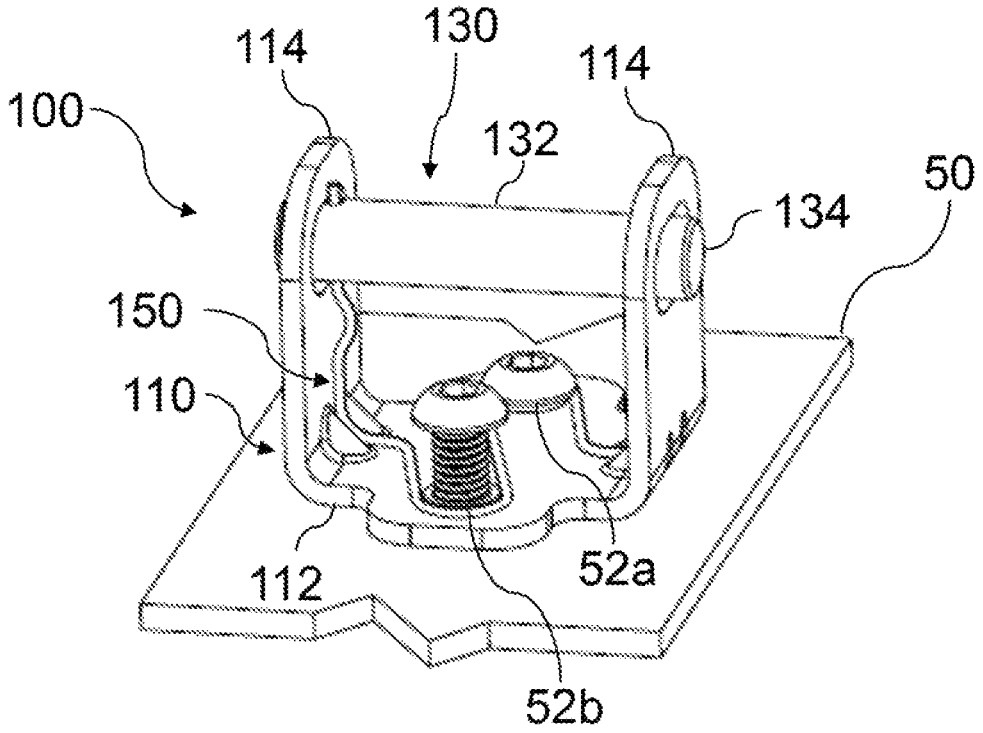
FIG. 5 depicts the exemplary striker assembly of FIG. 1A partially secured to a panel.

When a single spring 150 is used as in the preferred configuration, a single wire form can be used to center a striker pin in a housing or bracket. This configuration also facilitates the manufacture of a smaller striker design. Additionally, the preferred configuration of the striker assembly makes it possible to use only three main components (a spring, a support or housing, and a striker), thus reducing the inventory and assembly effort and cost as compared to striker assemblies having additional components. FIG. 5 depicts striker assembly 100 partially secured to a panel 50. As shown in FIG. 5, striker assembly 100 may be secured to panel 50 using fasteners 52*a* and 52*b* such as screws. In FIG. 5, fastener 52*a* has been tightened to panel 50, and fastener 52*b* has been partially tightened to panel 50 (in order to better illustrate spring 150). Portions of spring 150 encircling openings 116 may also be secured to base 112 of housing 110 by fasteners 52*a* and 52*b*. Securing spring 150 to housing 110 using fasteners 52*a* and 52*b* enables a fixed range of movement of striker 130 relative to housing 110, by fixing the range of biasing forces that may be applied to striker 130 by spring 150.

An exemplary operation of a latch assembly employing striker assembly 100 is described below with respect to FIGS. 6A-78.

Figure 6A:
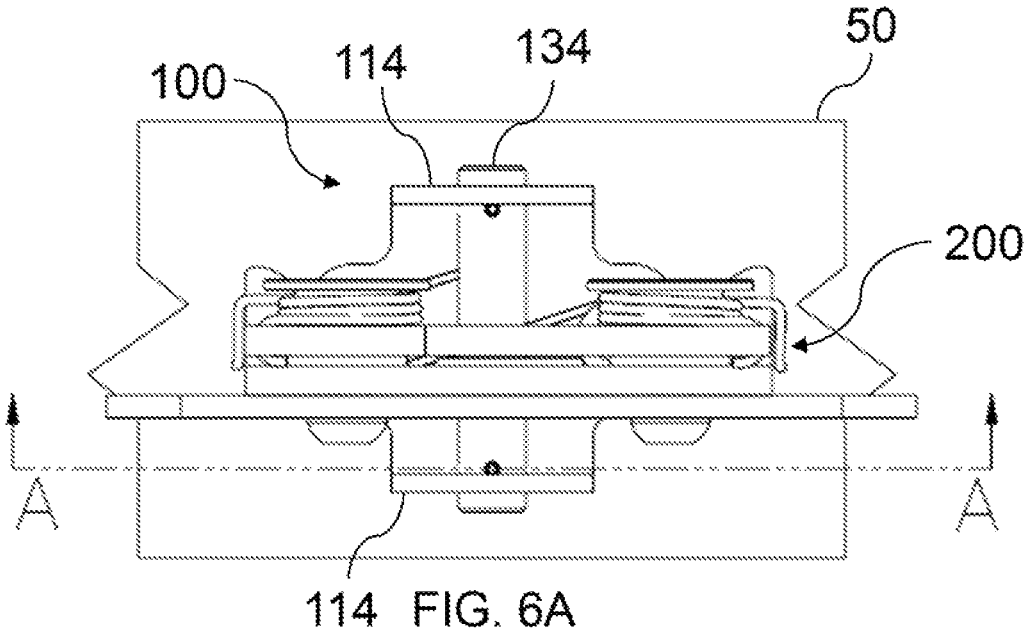
FIGS. 6A and 6B are top and side views, respectively, depicting an exemplary latch assembly in accordance with an aspect of the present invention incorporating the striker assembly of FIG. 1A in a first position.
Figure 6B:
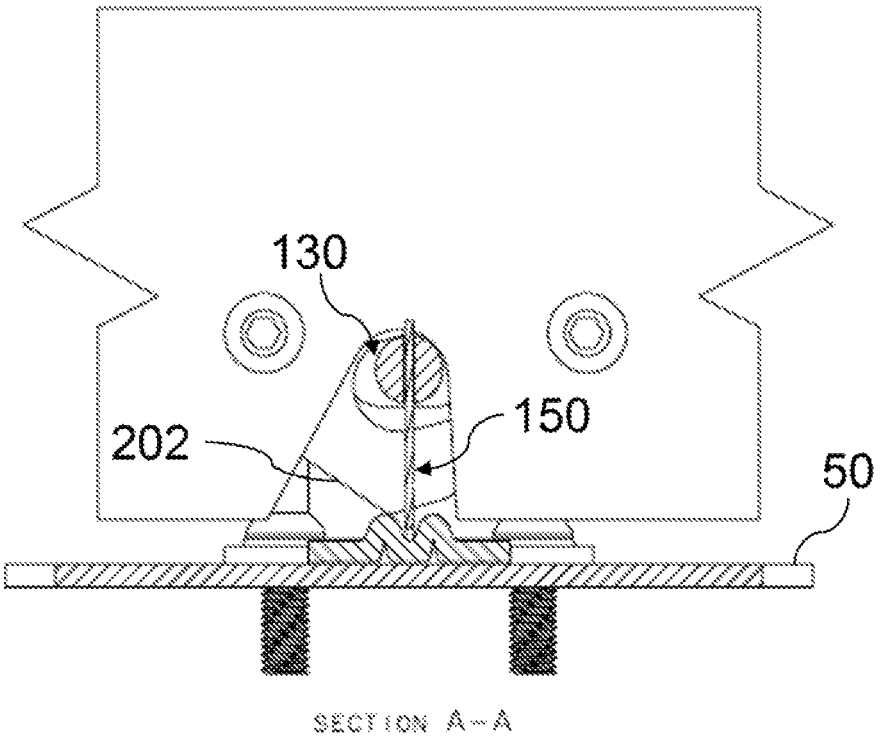

In FIGS. 6A and 6B, striker assembly 100 is secured to panel 50, and a latch 200 is engaged with striker assembly 100. Latch 200 includes a pawl 202. Additional details regarding the structure and operation of latch 200 are described, for example, in U.S. Pat. No. 7,726,707, incorporated by reference above. As shown in FIGS. 6A and 68B, striker assembly 100 is positioned to engage pawl 202, in particular with striker 130.

Figure 7A:
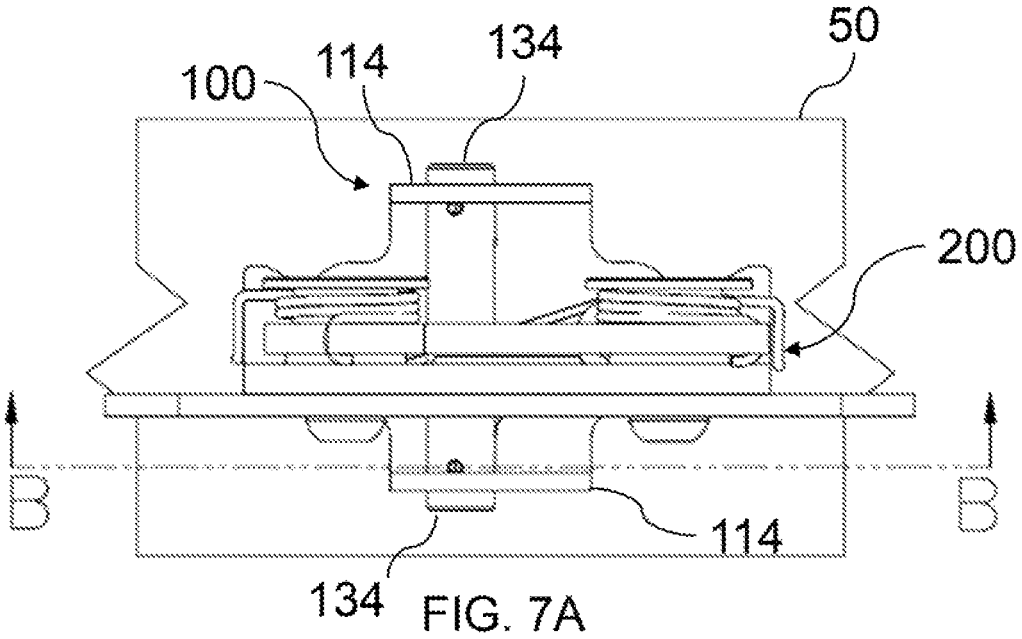
Figure 7B:
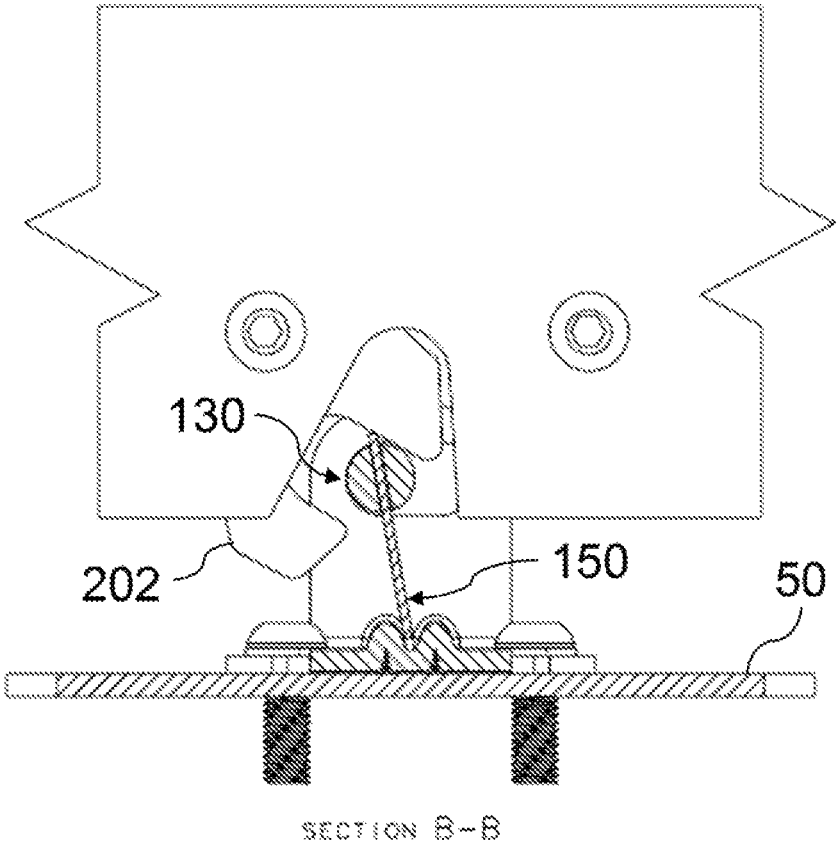

In FIGS. 7A and 78, latch 200 is operated to be disengaged from striker assembly 100. In particular, pawl 202 is rotated away from striker 130. As pawl 202 is rotated, contact between pawl 202 and striker 130 moves the end portions 134 of striker 130 transversely within their respective apertures away from the centered position of their respective apertures. This movement is resisted (but not prevented) by the biasing force provided by spring 150. Once pawl 202 is completely disengaged from striker 130, spring 150 biases end portions 134 of striker 130 back to the centered position of their respective apertures.

FIGS. 8A-8D illustrate another exemplary striker assembly 300 in accordance with aspects of the present invention. Striker assembly 300 may form part of a latch assembly. As a general overview, striker assembly 300 includes a support component such as housing 310, a striker 330, and a spring 350. Striker assembly 300 may incorporate any of the features or functions set forth above with respect to striker assembly 100, except as provided below.

Figure 9B:
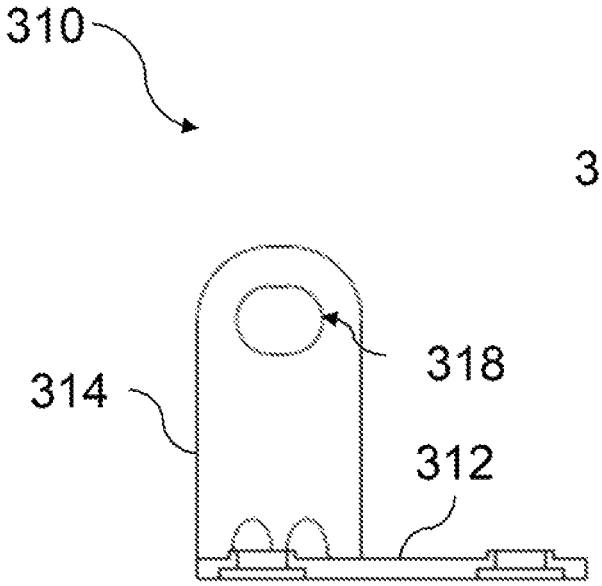
FIGS. 9A-9D depict an exemplary support in the form of a housing of the striker assembly of FIG. 8A.
Figure 9A:
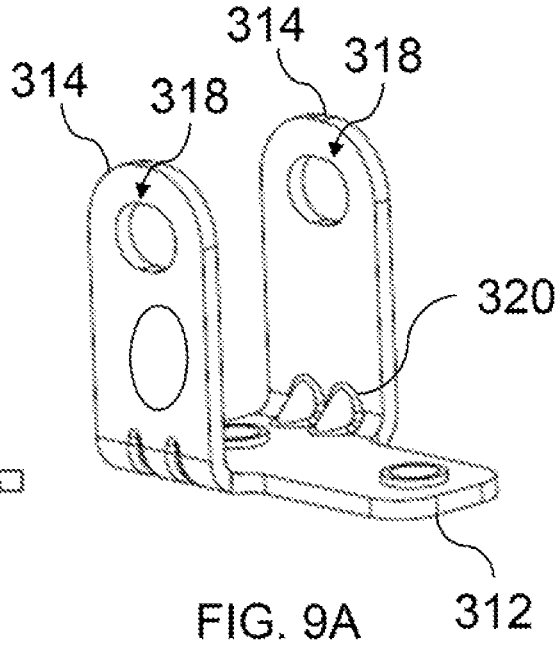
Figure 9C:
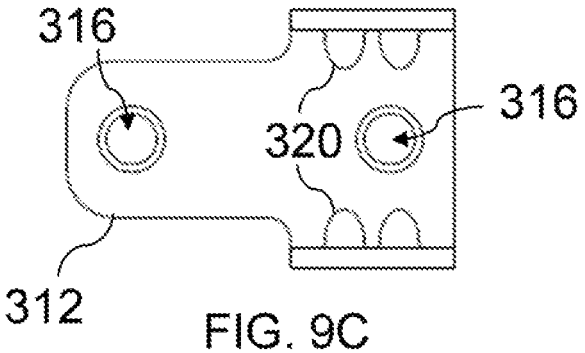
Figure 9D:
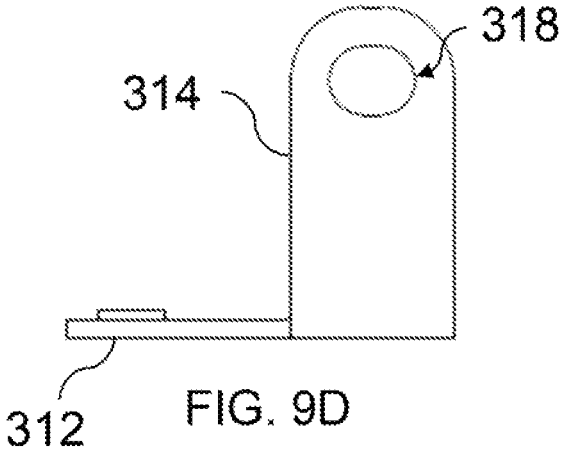

Housing 310 provides a base for striker assembly 300. As shown in FIGS. 9A-9D, housing 310 includes a base 312 and a pair of opposed side portions such as sidewalls 314 extending upward from the base 312. As shown in FIGS. 9A-9D, the sidewalls 314 of housing 310 are offset from a midpoint of base 312. In one embodiment, sidewalls 314 are provided at an end of base 312, as shown in FIG. 9C.

Base 312 of housing 310 includes one or more openings 316. Each sidewall 314 of housing 310 defines a respective aperture 318. Apertures 318 have at least one dimension that is sized to be larger than a dimension of the striker 330. Housing 310 may further include a pair of ridges 320 at an area of coupling between base 312 and each sidewall 314.

When striker assembly 300 is assembled, as shown in FIGS. 8A-8D, striker 330 extends between sidewalls 314 of housing 310, with each end positioned within a respective aperture 318. The end portions of striker 330 are movable transversely (i.e. orthogonally to the axis of striker 330) within their respective apertures 318.

Spring 350 biases striker 330 relative to housing 310. As shown in FIGS. 10A-10D, spring 350 has a body 352 with a pair of end portions 354 on opposite sides. An exemplary shape of spring 350 is set forth below.

In the exemplary embodiment of FIGS. 10A-10D, spring 350 includes a first straight portion 360 forming an end portion 354 of spring 350. The first straight portion 360 extends to a bump 362, and a second straight portion 364 extends from bump 362 to a first bend 366. It will be understood that bump 362 may be omitted, resulting in the first and second straight portions 360 and 364 forming a single straight portion. First bend 366 transitions (with or without an intervening straight portion) into a second bend 370. A third straight portion 372 extends from the second bend 370 to a third bend 374, and a fourth straight portion 376 extends from the third bend 374 to a fourth bend 378. A fifth straight portion 380 extends from the fourth bend 378, and forms another end portion 354 of spring 150. It will further be understood that this sixth straight portion 380 could also include a bump (similar to bump 362), either additionally or alternatively to bump 362, in which case the sixth straight portion would be divided into two straight portions (similar to first and second straight portions 360 and 364).

Figure 8A:
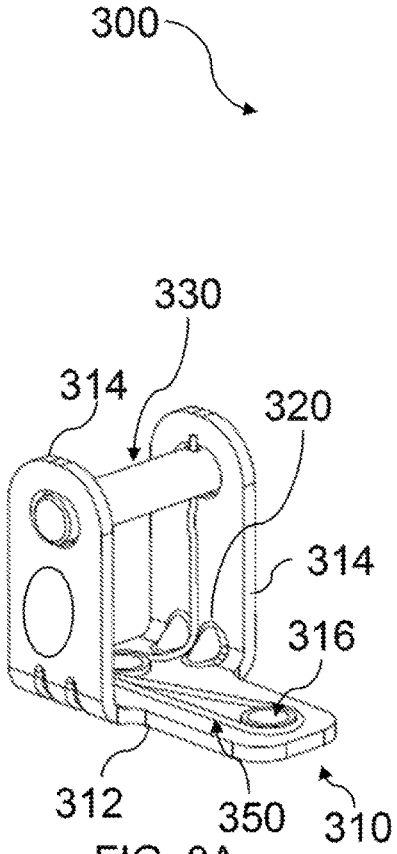
FIGS. 8A-8D depict another exemplary striker assembly in accordance with aspects of the present invention.
Figure 8B:
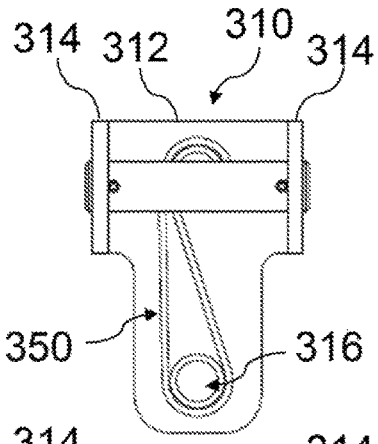
Figure 8C:
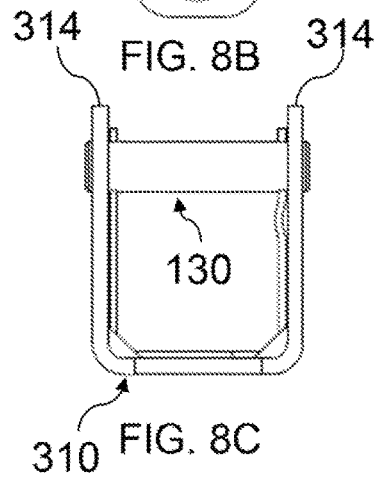
Figure 8D:
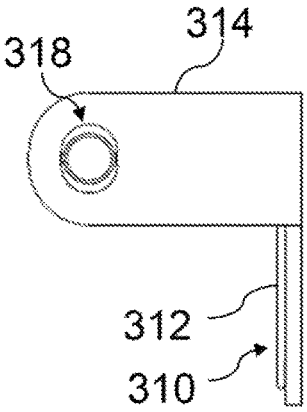
Figure 10A:
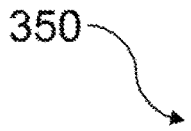
FIGS. 10A-10D depict an exemplary spring of the striker assembly of FIG. 8A.
Figure 10A:
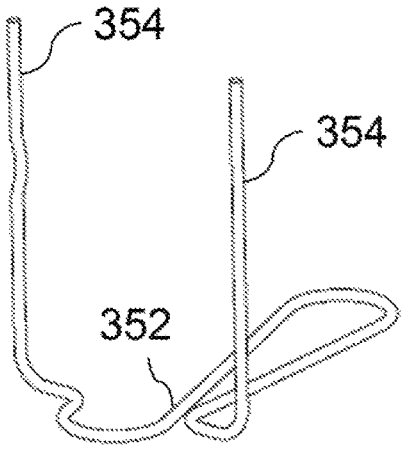
Figure 10B:
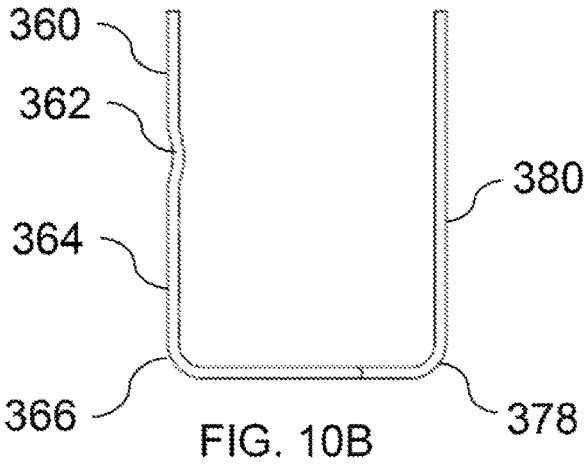
Figure 10D:
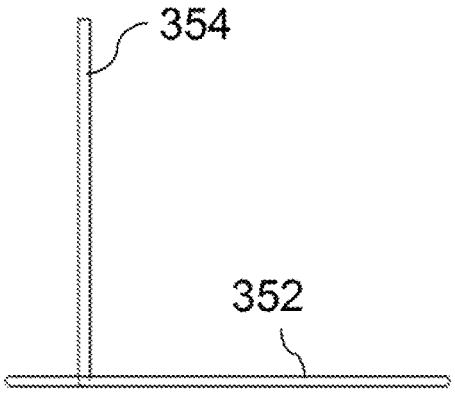
Figure 10C:
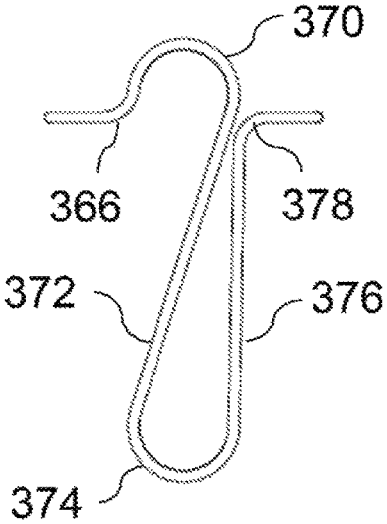
Figure 11A:
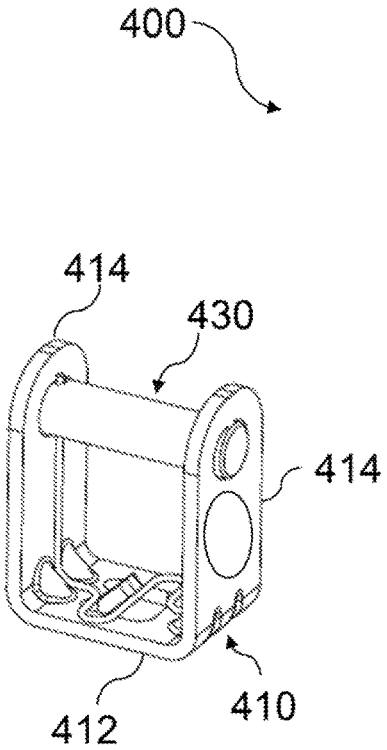
FIGS. 11A-11D depict yet another exemplary striker assembly in accordance with aspects of the present invention.
Figure 11B:
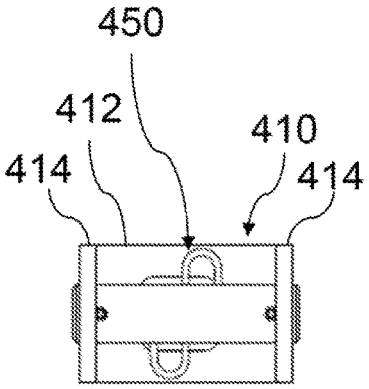
Figure 11C:
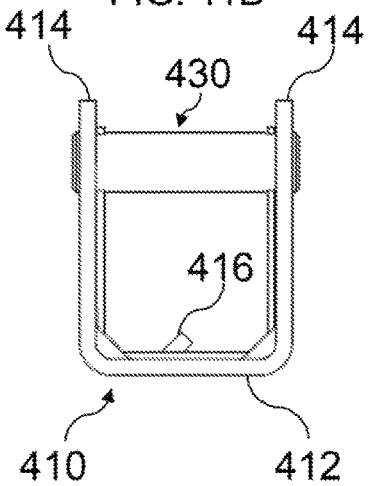
Figure 11D:
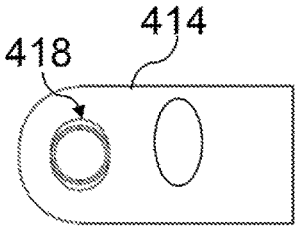
Figure 13A:
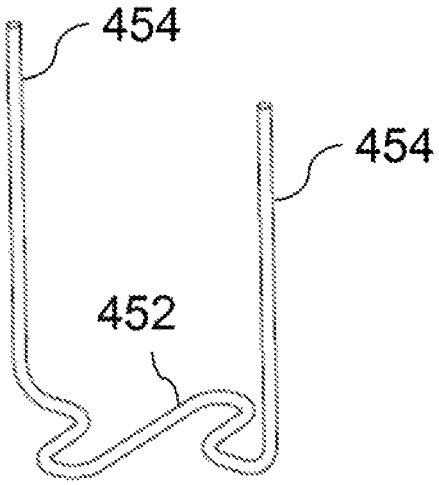
FIGS. 13A-13D depict an exemplary spring of the striker assembly of FIG. 11A.
Figure 13B:
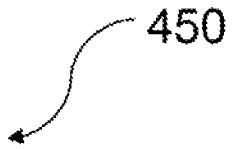
Figure 13B:
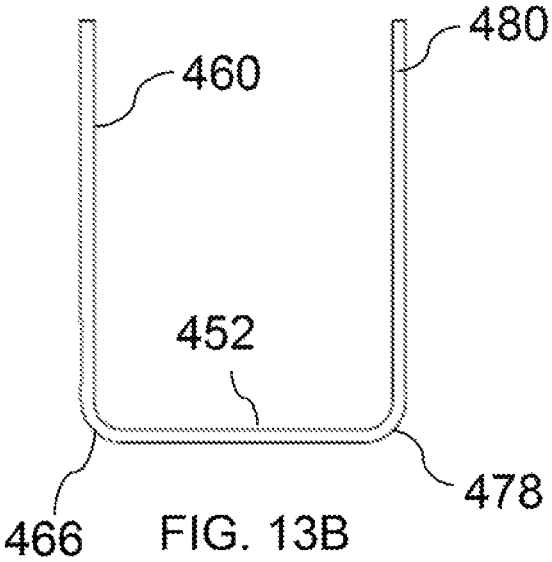
Figure 13D:
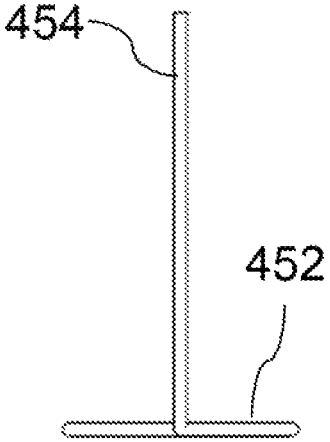
Figure 13C:
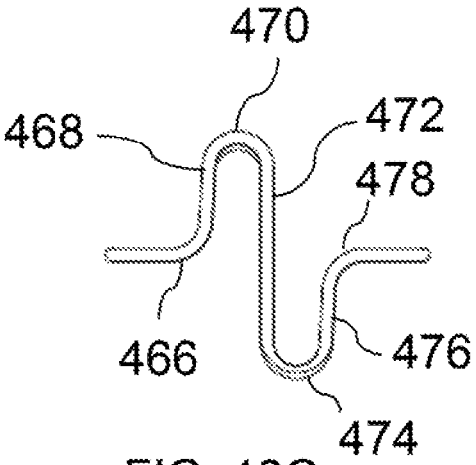

When striker assembly 300 is assembled, body 352 of spring 350 is coupled with housing 310. In an exemplary embodiment, body 352 of spring 350 passes through each channel defined by the pairs of ridges 320 in the area of coupling of sidewalls 314 to base 312 of housing 310. Further, body 352 of spring 350 at least partially encircles outer edges of the openings 316 in housing 310, in order to secure spring 350 to housing 310 when fasteners are in place. In the embodiment of FIGS. 8B and 10B, second bend 370 and third bend 374 in body 352 of spring 350 partially encircle the outer edges of openings 316 in housing 310.

FIGS. 11A-11D illustrate another exemplary striker assembly 400 in accordance with aspects of the present invention. Striker assembly 400 may form part of a latch assembly. As a general overview, striker assembly 400 includes a support component such as housing 410, a striker 430, and a spring 450. Striker assembly 400 may incorporate any of the features or functions set forth above with respect to striker assemblies 100 and/or 300, except as provided below.

Housing 410 provides a base for striker assembly 400. As shown in FIGS. 12A-12D, housing 410 includes a base 412 and a pair of opposed side portions such as sidewalls 414 extending upward from the base 412. Base 412 of housing 410 includes a protrusion 416 extending upwardly therefrom. Protrusion 416 has an upper surface facing away from base 412 and a lower surface facing toward base 412. Base 412 may further include a cutout in an area beneath protrusion 416. Each sidewall 414 of housing 410 defines a respective aperture 418. Apertures 418 have at least one dimension that is sized to be larger than a dimension of the striker 430.

When striker assembly 400 is assembled, as shown in FIGS. 11A-11D, striker 430 extends between sidewalls 414 of housing 410, with each end positioned within a respective aperture 418. The end portions of striker 430 are movable transversely (i.e. orthogonally to the axis of striker 430) within their respective apertures 418. Inasmuch as striker assembly 400 may lack openings sized to receive a fastener (such as openings 116), striker assembly 400 may be secured to another object, such as a panel or frame, using alternate methods, such as by welding.

Spring 450 biases striker 430 relative to housing 410. As shown in FIGS. 13A-13D, spring 450 has a body 452 with a pair of end portions 454 on opposite sides. An exemplary shape of spring 450 is set forth below.

In the exemplary embodiment of FIGS. 13A-13D, spring 450 includes a first straight portion 460 forming an end portion 454 of spring 450. The first straight portion 460 extends to a first bend 466. A second straight portion 468 extends from the first bend 466 to a second bend 470. A third straight portion 472 extends from the second bend 470 to a third bend 474, and a fourth straight portion 476 extends from the third bend 474 to a fourth bend 478. A fifth straight portion 480 extends from the fourth bend 478, and forms another end portion 454 of spring 450. It will further be understood that either straight portion 460 or 480 could include a bump (similar to bump 162), in which case the respective straight portion would be divided into two straight portions.

When striker assembly 400 is assembled, body 452 of spring 450 is coupled with housing 410. In an exemplary embodiment, body 452 of spring 450 passes through each channel defined by the pairs of ridges 420 in the area of coupling of sidewalls 414 to base 412 of housing 410. Further, body 452 of spring 450 extends into a space defined beneath the lower surface of protrusion 416, i.e., between protrusion 416 and base 412 of housing 410, in order to secure spring 450 to housing 410.

A floating striker according to aspects of this invention accommodates or compensates for any misalignment of a latch, such as a rotary latch, and a striker. As described previously, a spring formed according to aspects of this invention allows the striker to move and/or adjust to find the correct home position in the latch assembly. This can provide an automatic self-adjusting feature for any latch system. This can be of significant benefit for an end user as a latch assembly wears in the field.

This invention also provides a latchable assembly of components having latched and unlatched conditions. The latchable assembly includes components moveable relative to one another between an open position in the unlatched condition and a closed position in the latched condition. One of the components may be fixed in position and another one of the components may be movable relative to the fixed component. For example, the fixed component can include a frame portion and the movable component can include a door portion. For illustration, the frame portion can be part of a vehicle body and the door portion can be part of a vehicle door. In this example, the latch can be coupled to the door portion or to the frame portion, and the striker can be coupled to the other of the frame portion or the door portion. U.S. Pat. Nos. 7,726,707 and 8,496,275, which are incorporated herein by reference in their entireties, provide additional examples of components with which a striker assembly, latch assembly or latchable assembly of this invention can be used.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction, where the surface defined in each end portion of the striker at least partially forms a hole that extends diametrically through the respective end portion; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture.

2. The striker assembly of claim 1, wherein the housing further includes one or more openings sized to receive a fastener.

3. The striker assembly of claim 1, wherein the housing further includes a base extending between the sidewalls of the housing and a protrusion extending from the base thereof.

4. The striker assembly of claim 1, wherein the housing further includes a base and a pair of ridges defining a channel at an area of coupling between each sidewall and the base.

5. The striker assembly of claim 4, wherein the spring includes a body passing through each channel of the housing.

6. The striker assembly of claim 1, wherein each spring end portion extends through the respective hole in each striker end portion.

7. The striker assembly of claim 1, wherein the spring is engaged with the housing and the striker to limit movement of the striker axially through either aperture of the housing.

8. The striker assembly of claim 1, wherein the spring is formed from a single piece of wire including a plurality of bends.

9. The striker assembly of claim 1, wherein at least one of the apertures defined in the sidewalls of the housing includes a slot.

10. The striker assembly of claim 1, wherein each of the end portions of the striker is movable transversely within the respective aperture away from the centered position of the respective aperture and is biased toward the centered position of the respective aperture.

11. The striker assembly of claim 1, wherein the housing further includes a base extending between the sidewalls of the housing and the sidewalls are offset from a midpoint of the base of the housing.

12. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture, wherein the housing further includes one or more openings sized to receive a fastener, and wherein the spring includes a body that at least partially encircles an outer edge of each of the one or more openings in the housing.

13. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture, wherein the housing further includes a base extending between the sidewalls of the housing and a protrusion extending from the base thereof, and wherein the spring includes a body portion that extends into a space defined between the protrusion and the base of the housing.

14. The striker assembly of claim 13, wherein the base further includes a cutout in an area beneath the protrusion.

15. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture, wherein the spring is formed from a single piece of wire, and wherein the single piece of wire includes a first straight portion extending to a first bend, a second straight portion extending from the first bend to a second bend, a third straight portion extending from the second bend to a third bend, a fourth straight portion extending from the third bend to a fourth bend, and a fifth straight portion extending from the fourth bend.

16. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture, wherein the spring is formed from a single piece of wire, and wherein the single piece of wire includes a first straight portion extending to a bump, a second straight portion extending from the bump to a first bend, a third straight portion extending from the first bend to a second bend, a fourth straight portion extending from the second bend to a third bend, a fifth straight portion extending from the third bend to a fourth bend, and a sixth straight portion extending from the fourth bend.

17. A striker assembly comprising:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture and is biased toward the centered position of the respective aperture, wherein the spring is formed from a single piece of wire, and wherein the single piece of wire includes a first straight portion extending to a first bump, a second straight portion extending from the bump to a first bend, a third straight portion extending from the first bend to a second bend, a fourth straight portion extending from the second bend to a third bend, a fifth straight portion extending from the third bend to a fourth bend, and a sixth straight portion extending from the fourth bend to a second bump, and a seventh straight portion extending from the second bump.

18. A striker assembly comprising:

a housing having a base and a pair of opposed sidewalls extending from the base, the base including one or more openings sized to receive a fastener, each of the sidewalls defining an aperture, the housing further including a pair of ridges defining a channel at an area of coupling between each sidewall and the base;

a striker having a pair of end portions, the striker extending between the sidewalls with each of the pair of end portions positioned within a respective aperture, each of the pair of end portions having a hole extending diametrically therethrough; and a single spring having a body and a pair of end portions, each spring end portion extending through the hole in a respective striker end portion, the spring engaged with the housing such that the body of the spring passes through each channel and at least partially encircles an outer edge of each of the openings in the base of the housing, wherein the end portions of the striker are movable transversely within the respective aperture away from a centered position of the respective aperture and are biased toward the centered position of the respective aperture.

19. A latch assembly comprising:

a latch having a pawl;

a striker assembly positioned to engage the pawl of the latch, the striker assembly including:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction, where the surface defined in each end portion of the striker at least partially forms a hole that extends diametrically through the respective end portion; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture upon contact with the pawl of the latch and is biased toward the centered position of the respective aperture upon release of the pawl of the latch.

20. The latch assembly of claim 19, wherein the latch is a rotary latch and the pawl is mounted for rotation between engaged and disengaged orientations.

21. A latchable assembly of components having latched and unlatched conditions, the latchable assembly comprising:

components moveable relative to one another between an open position in the unlatched condition and a closed position in the latched condition;

a latch having a pawl, the latch being coupled to one of the components;

a striker assembly positioned to engage the pawl of the latch, the striker assembly being coupled to an other of the components and including:

a housing having opposed sidewalls, each of the sidewalls defining an aperture;

a striker having a pair of end portions, the striker extending between the sidewalls of the housing with each of the pair of end portions positioned within a respective aperture defined in the sidewalls of the housing, each of the pair of end portions defining a surface extending in a transverse direction, where the surface defined in each end portion of the striker at least partially forms a hole that extends diametrically through the respective end portion; and a spring having a pair of end portions, each spring end portion contacting the surface of a respective striker end portion, the spring engaged with the housing to bias the end portions of the striker toward a centered position of the respective apertures;

wherein at least one of the end portions of the striker is movable transversely within the respective aperture away from the centered position of the respective aperture upon contact with the pawl of the latch as the components are moved from the open position to the closed position; and wherein the at least one end portion of the striker is biased toward the centered position of the respective aperture upon release of the pawl of the latch as the components are moved from the closed position to the open position.

22. The latchable assembly of claim 21, wherein one of the components is fixed in position and an other one of the components is movable relative to the fixed component.

23. The latchable assembly of claim 22, wherein the fixed component includes a frame portion and the movable component includes a door portion.

24. The latchable assembly of claim 23, wherein the latch is coupled to the frame portion and the striker is coupled to the door portion.

25. The latchable assembly of claim 23, wherein the latch is coupled to the door portion and the striker is coupled to the frame portion.

* * * * *